US010414172B2

(12) United States Patent
Halevi et al.

(10) Patent No.: US 10,414,172 B2
(45) Date of Patent: Sep. 17, 2019

(54) PRINTER AND IMAGE PROCESSING

(71) Applicant: HP SCITEX LTD., Netanya (IL)

(72) Inventors: Eviatar Halevi, Macabim (IL); Alex Veis, Kadima (IL); Maria Elizabeth Zapata, Barcelona (ES)

(73) Assignee: HP SCITEX LTD., Netanya (IL)

( * ) Notice: Subject to any disclaimer, the term of this patent is extended or adjusted under 35 U.S.C. 154(b) by 118 days.

(21) Appl. No.: 14/764,520

(22) PCT Filed: Jan. 31, 2013

(86) PCT No.: PCT/IL2013/050089

§ 371 (c)(1),
(2) Date: Jul. 29, 2015

(87) PCT Pub. No.: WO2014/118766

PCT Pub. Date: Aug. 7, 2014

(65) Prior Publication Data

US 2015/0360481 A1 Dec. 17, 2015

(51) Int. Cl.
*B41J 2/21* (2006.01)
*B41J 11/00* (2006.01)

(52) U.S. Cl.
CPC ..... *B41J 11/0015* (2013.01); *B41J 2/2114* (2013.01); *B41J 11/002* (2013.01); *Y10T 428/24802* (2015.01)

(58) Field of Classification Search
None
See application file for complete search history.

(56) References Cited

U.S. PATENT DOCUMENTS 5,234,783 A * 8/1993 Ng ..... G03G 8/00 430/45.53
6,108,512 A * 8/2000 Hanna ..... G03G 21/043 283/902
6,116,158 A 9/2000 DeMoore et al.
6,167,224 A * 12/2000 Dalal ..... G03G 13/013 399/222

(Continued)

FOREIGN PATENT DOCUMENTS

CN 102431294 5/2012
EP 1571827 9/2005

(Continued)

OTHER PUBLICATIONS

Application Notes. Printing with White Ink or Finish/Varnish. ergosoft rip solutions, 2010.*

(Continued)

*Primary Examiner* — Ted W Barnes
(74) *Attorney, Agent, or Firm* — HP Inc. Patent Department

(57) ABSTRACT

According to one example, there is provided a method of processing an image. The method comprises obtaining image data representing an image to be printed, determining, from the image data, pixel locations on a substrate where ink is intended to be deposited and pixel locations where no ink is intended to be deposited, and modifying the image data to define varnish to be deposited at at least some of those substrate pixel locations determined as where no ink is intended to be deposited.

10 Claims, 7 Drawing Sheets

(56) References Cited

U.S. PATENT DOCUMENTS 6,344,260 B1 * 2/2002 Lythgoe ..... B41M 3/12 428/195.1
6,464,349 B1 * 10/2002 Moriyama ..... B41J 2/2114 347/101
6,503,978 B1 * 1/2003 Tsao ..... B41J 11/0015 106/31.6
6,760,638 B1 * 7/2004 Love ..... G06T 11/60 358/1.18
6,806,018 B2 10/2004 Kanga et al.
6,857,733 B2 * 2/2005 Issler ..... C09D 11/40 347/100
6,953,244 B2 * 10/2005 Chen ..... B41J 2/2114 347/100
7,352,493 B2 * 4/2008 Liu ..... B41M 5/00 358/3.06
7,652,794 B2 1/2010 Lee
8,285,187 B2 * 10/2012 Kimura ..... G03G 15/5062 399/341
8,634,110 B2 * 1/2014 Ulichney ..... H04N 1/4092 358/1.9
2005/0001878 A1 * 1/2005 Yamasaki ..... B41J 2/2103 347/43
2005/0128524 A1 * 6/2005 Liu ..... B41M 5/00 358/3.06
2005/0135851 A1 * 6/2005 Ng ..... G03G 15/2003 399/341
2005/0185004 A1 * 8/2005 Couwenhoven ..... B41J 2/2114 347/6
2005/0185008 A1 * 8/2005 Couwenhoven ..... B41J 2/2114 347/14
2005/0286083 A1 * 12/2005 Wang ..... G03G 8/00 358/3.06
2006/0044617 A1 * 3/2006 Wang ..... G06K 15/02 358/3.06
2006/0285890 A1 * 12/2006 Ng ..... G03G 15/2064 399/329
2007/0013759 A1 * 1/2007 Kadomatsu ..... B41J 2/2114 347/102
2007/0048653 A1 * 3/2007 Ide ..... G03G 5/144 430/123.52
2007/0279454 A1 * 12/2007 Sato ..... C07K 14/78 347/43
2007/0287082 A1 * 12/2007 Ng ..... H04N 1/54 430/47.5
2008/0079971 A1 * 4/2008 Liu ..... B41M 5/00 358/1.9
2008/0192297 A1 * 8/2008 Wang ..... H04N 1/32203 358/3.06
2008/0239401 A1 * 10/2008 Stevens ..... G06K 15/02 358/3.06
2009/0169277 A1 * 7/2009 Fowlkes ..... G03G 15/5025 399/341
2009/0207223 A1 * 8/2009 Cofler ..... B41J 3/28 347/102
2009/0258306 A1 * 10/2009 Liu ..... G03G 13/14 430/48
2010/0194838 A1 * 8/2010 Mitsuzawa ..... B41J 2/2114 347/102
2010/0329717 A1 * 12/2010 Yoshioka ..... G03G 15/0142 399/68
2011/0038655 A1 * 2/2011 Ng ..... G03G 15/2003 399/341
2011/0039202 A1 * 2/2011 Ng ..... G03G 15/2003 430/124.1
2011/0235062 A1 * 9/2011 Suzuki ..... G03G 15/0131 358/1.2
2012/0056926 A1 * 3/2012 Mitsuzawa ..... B41J 2/2114 347/14
2012/0069109 A1 * 3/2012 Anderson ..... B41M 7/0081 347/102
2012/0086984 A1 * 4/2012 Ulichney ..... H04N 1/4092 358/3.06
2012/0105915 A1 * 5/2012 Kobayashi ..... H04N 1/52 358/3.06
2013/0021398 A1 * 1/2013 Mizes ..... B41J 2/2114 347/14
2013/0050322 A1 * 2/2013 Vall ..... B41J 2/175 347/14
2013/0061767 A1 * 3/2013 Casals ..... B41M 1/14 101/202
2013/0064588 A1 * 3/2013 Akita ..... G03G 15/6585 399/341
2013/0113868 A1 * 5/2013 Veis ..... B41J 11/0015 347/102
2013/0293612 A1 * 11/2013 Smith ..... B41J 2/2114 347/14
2014/0049577 A1 * 2/2014 Rimai ..... B41M 7/009 347/16
2015/0024118 A1 * 1/2015 Veis ..... B05B 3/00 427/8
2016/0368286 A1 * 12/2016 Rossinyol Casals .... B41M 1/14

FOREIGN PATENT DOCUMENTS

| | | |
|---|---|---|
| JP | 2003-191601 | 7/2003 |
| JP | 2005-199563 | 7/2005 |
| JP | 2005-199659 | 7/2005 |
| JP | WO2010/021377 | 2/2010 |
| JP | 2010-179537 | 8/2010 |
| JP | 2012-179852 | 9/2012 |
| JP | 2012-223997 | 11/2012 |
| JP | 2012-232470 | 11/2012 |
| JP | 2013-010188 | 1/2013 |

OTHER PUBLICATIONS

"Coating Blankets", Flint Group, 17pages, http://www.flintgrp.com/en/documents/Print-Media/Europe/Coating_Blankets.pdf.
Druckerei, Paul Gerin, "Perfecting in perfection", May 2009, 4 pages.

* cited by examiner

PRINTER AND IMAGE PROCESSING

BACKGROUND

It is common to protect certain printed articles, such as posters, signage prints, and articles intended to be formed into packaging items, with a clear protective layer such as a clear varnish. A protective layer is typically used to increase the robustness of both the printed ink and the substrate itself. For example, a varnish may protect the printed image and the substrate from being scratched or scuffed, as well as adding a degree of water resistance.

BRIEF DESCRIPTION

Examples, or embodiments, of the invention will now be described, by way of non-limiting example only, with reference to the accompanying drawings, in which.

DETAILED DESCRIPTION

Typically, a clear protective layer (referred to hereinafter as varnish) is applied uniformly on a printed substrate, covering both printed and, where applicable, non-printed portions thereof. This is especially the case where printed articles are produced using traditional offset printing techniques.

However, some modern printing inks, such as ultra-violet curable inks, are particularly robust.

Figure 1:
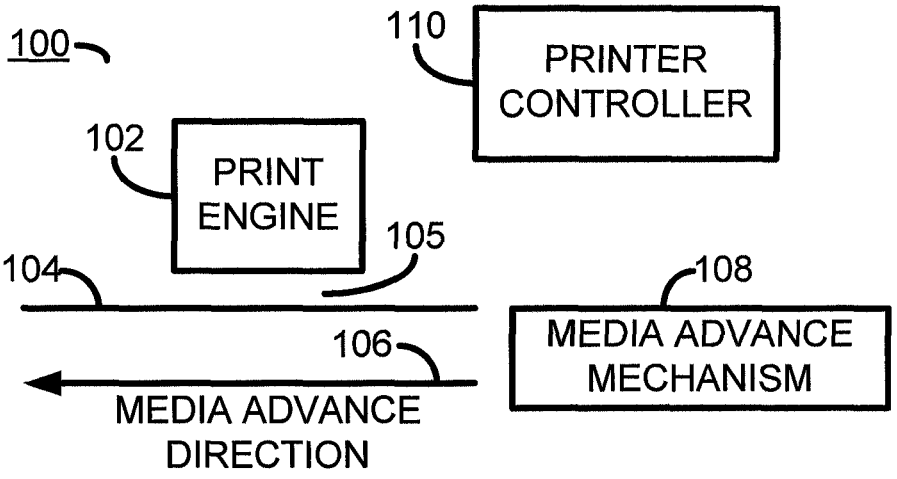
FIG. 1 is a simplified illustration of a printing system according to one example.

Referring now to FIG. 1, there is shown a simplified illustration of a printing system 100 according to one example. The printing system 100 comprises a print engine 102 for printing on a substrate, such as a substrate 104. The substrate 104 is advanced through a print zone 105 of the print engine 102 by a media advance mechanism 108 in a media advance direction 106. In one example the media advance mechanism 108 may include one or multiple rollers. In another example the media advance mechanism 108 may include a transport belt or other suitable media advance device.

The operation of the printing system 100 is generally controlled by a printer controller 110.

In one example the print engine 102 is an inkjet print engine that comprises one or multiple inkjet printheads. Each printhead comprises an array of printhead nozzles through which drops of printing fluid may be selectively ejected. The arrangement and spacing of the nozzles in the printhead defines a printing resolution of the printing system 100. In one example the nozzles may be arranged to allow the printing system 100 to print at resolutions of up to 600 dots per inch (DPI). In other examples the nozzles may be arranged to allow the printing system 100 to print at other higher or lower resolutions, such as 300 DPI and 1200 DPI.

The resolution of the printing system 100 together with the width of the substrate to be printed on defines the number of pixel locations on a substrate that are printable on across the width of the substrate Hereinafter the pixel locations are referred to as substrate pixel locations.

The printheads are controllable by the printer controller 110, in accordance with image data, such as printhead control data, representing an image to be printed, to eject drops of printing fluid, such as ink, onto a substrate pixel locations on a substrate positioned in the print zone 105. In one example the printheads are mounted on a carriage (not shown) movable bi-directionally in an axis perpendicular to the media advance direction 106. In another example the printheads are configured to span the entire width of the media 105 such that the printheads do not need to scan across the print zone, in a so-called page-wide array configuration.

In one example the printheads are piezo inkjet printheads. In another example the printheads are thermal inkjet printheads.

Where the print engine 102 comprises multiple inkjet printheads each printhead may be configured to print with a different coloured printing fluid, such as different coloured printing inks. In one example, the print engine 102 with may have four printheads each configured to print with one of a cyan (C), magenta (M), yellow (Y), or black (K) coloured ink. Ink may be supplied to each printhead by a suitable ink supply system (not shown). In one example, one or multiple further printheads may be provided in the print engine 102 for printing with a varnish.

In one example the printing fluids used by the print engine 102 are ultra-violet curable printing fluids, such as the range of Hewlett-Packard UV curable inks available from Hewlett-Packard Company, that are printed in liquid form and which are cured after printing through exposure to ultra-violet radiation from a UV radiation source. In one example, one or multiple UV radiation sources are provided in proximity to the print engine to cure or pin (i.e. partially cure) printed UV curable ink.

Once cured, UV curable inks have a high degree of physical robustness. For example, such inks typically exhibit a high degree of scratch and scuff resistance, and are also water impermeable.

Examples described herein take advantage of the aforementioned physical properties of cured UV curable inks to produce resistant printed articles whilst reducing the quantity of protective varnish used. This is achieved, as will be described in further detail below, by only printing varnish on selective substrate pixel locations.

Examples described herein provide a method of modifying image data representing an image to be printed by performing processing operations thereon. The processing operations may be described in a computer understandable instructions that, when executed by a suitable processing system, cause the processing system to perform the processing operations described herein according to various examples.

In different examples the methods described herein may be implemented in various different ways.

For example, in one example, a method may be implemented by a graphical image editing computer application for execution on a computer, laptop, server, or the like. In another example, a method may be implemented by a raster image processor (RIP) application running on a computer, laptop, server, or the like.

In further example, a method may be implemented by a printer driver running on a computer, laptop, server, or the like.

In a yet further example, a method may be implemented by a controller, such as the printer controller 110, or be performed by firmware in a printing system.

Figure 2:
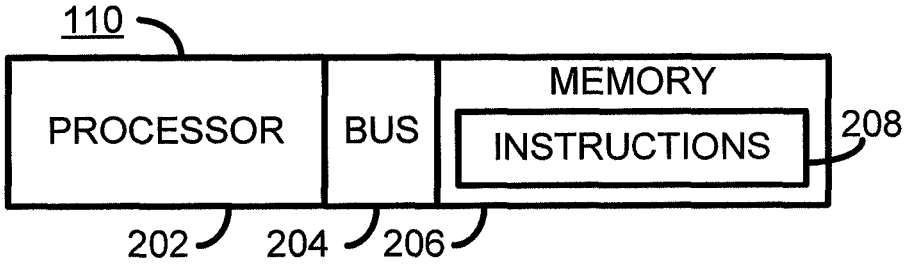
FIG. 2 is a block diagram of a processing system according to one example.

A more detailed illustration of the printer controller 110 is shown in FIG. 2. The controller 110 comprises a processor 202 such as a microprocessor, a microcontroller, a computer processor, or the like. The processor 202 is in communication with a memory 206 via a communication bus 204. The memory 206 stores computer understandable instructions 208 that, when executed by the processor 202 cause the processing system 200 to perform the processing operations described herein.

Figure 3:
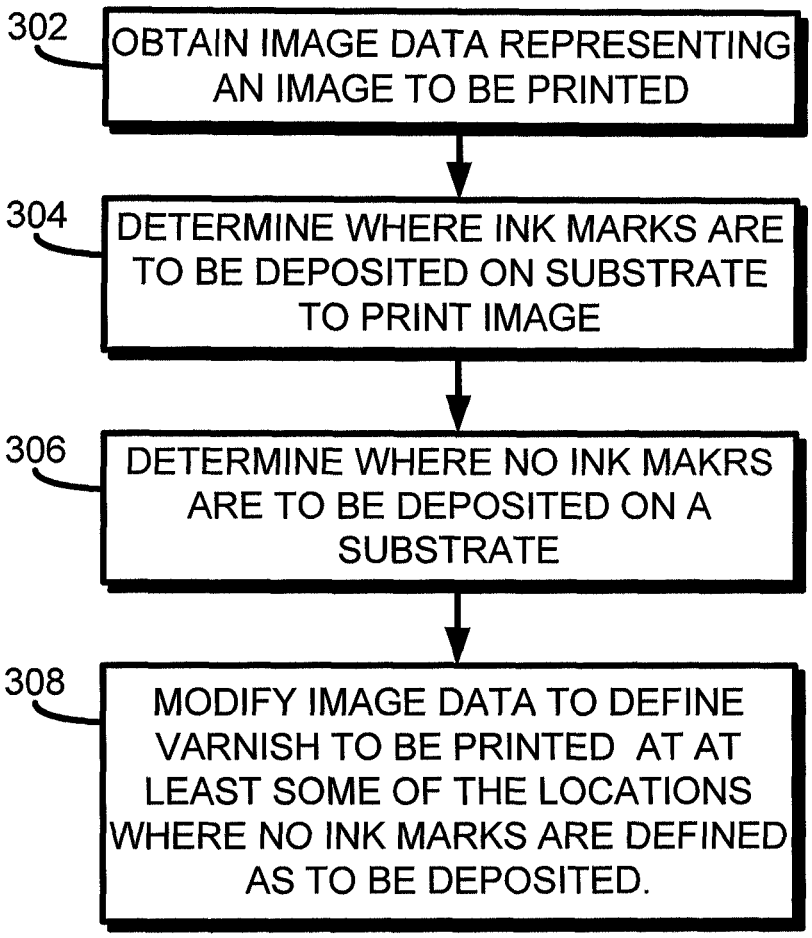
FIG. 3 is a flow diagram outlining a method of processing an image according to one example.

A method of processing an image in accordance with one example will now be described with reference to the flow diagram of FIG. 3, and with additional reference to FIGS. 5 to 8.

At block 302 the method obtains image data representing an image to be printed. In one example the image data comprises data representing one or multiple colour separations or colour channels.

In one example the image data is generated from an application such as a raster image processor (RIP), for example, as a result of performing image processing such as halftoning on a digital image. Accordingly, the image data defines, or enables to be determined, substrate pixel locations at which printing fluid is intended to be deposited. The term 'intended' is used above since inaccuracies in printing systems may result in printing fluid being deposited at pixel locations other than those intended, for example as a result of drop placement errors, media advance errors, satellite drops, and the like.

To facilitate understanding, it is assumed that a print engine to be used to print image data described herein is a print engine that produces fixed sized printing fluid drops. It will be appreciated, however, that the techniques and methods described herein may equally be adapted for use with print engines that produce variable size ink drops.

Based on the printing resolution of the printing system 100 an array of substrate pixel locations are addressable by the print engine 102. By addressable is meant that the print engine 102 is able to selectively eject ink drops at specific substrate pixel locations from one or more of the printheads.

Figure 4:
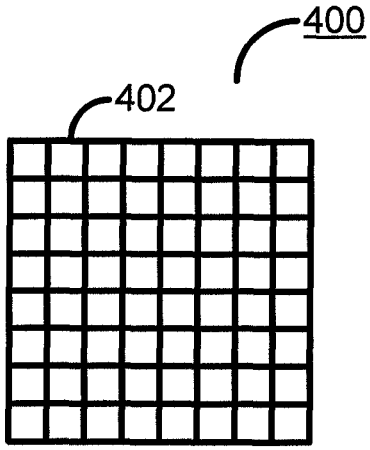
FIG. 4 is a magnified illustration of an array of substrate pixel locations according to one example.

FIG. 4 shows an illustration, in a magnified view, of an array 400 of substrate pixel locations 402 addressable by the print engine 102, according to one example. For the purposes of illustration the array 400 shows a grid of square pixels. However, it will be appreciated that drops of printing fluid when printed at a substrate pixel location are not square in nature.

At block 304 the method determines from the image data those substrate pixel locations 402 where ink drops are to be deposited on a substrate, for example by one or multiple ones of the printheads in the print engine 102. Depending on the image content and halftoning techniques used, each substrate pixel location on a substrate may be defined to receive zero or more ink drops.

Figure 5:
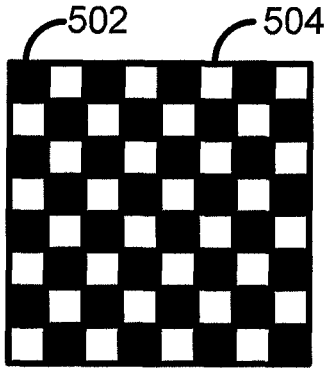
FIG. 5 is a magnified illustration of an array of substrate pixel locations according to one example.

As is well known, when printing a continuous tone image using a limited set of process colours (e.g. a CMYK printing system) halftoning techniques are used to give an observer the appearance of seeing a continuous tone image. For example, a patch having a 50% grey scale may be printed using only black ink by leaving a predetermined amount of space between adjacent drops of black ink, as illustrated in FIG. 5. In FIG. 5 half of the substrate pixel locations are defined as having black ink drops (502) to be deposited thereon, and half of the substrate pixel locations are defined as not having any ink drops to be deposited thereon. The effect of this when a printed image is viewed by an observer is a light grey colour.

However, at those substrate pixel locations that are defined as not to be printed on (504) a substrate would not be protected by ink drops.

At block 306 the method determines at which substrate pixel locations, such as substrate pixel locations 504 (FIG. 5), no ink drops are defined as to be deposited.

At block 308 the method modifies the obtained image data to define varnish to be printed at at least some of the locations where no ink marks are defined as to be deposited.

Figure 6:
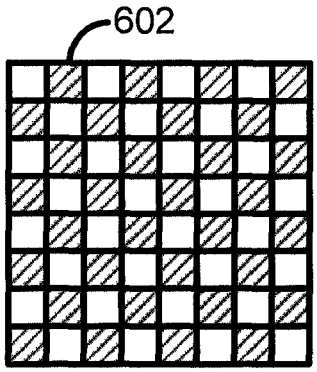
FIG. 6 is a magnified illustration of an array of substrate pixel locations according to one example.
Figure 7:
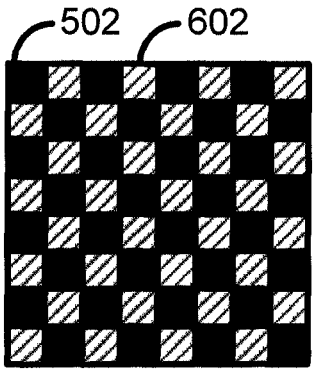
FIG. 7 is a magnified illustration of an array of substrate pixel locations according to one example.

In one example the method modifies the obtained image data to define varnish to be printed on all of the substrate pixel locations 504 where no ink is defined as to be deposited, depicted by varnish drops 602 in FIG. 6. The result of this is illustrated in FIG. 7, where it can be seen that all substrate pixel locations are defined as having either a drop of ink 502 or a drop of varnish 602 to be deposited thereon.

When the modified image data is printed, a printed substrate will have ink printed thereon at some substrate pixel locations. All, or substantially all (depending on printing system inaccuracies), pixel locations not having ink printed thereon will have varnish printed thereon. In one example, those substrate pixel locations that have ink printed thereon do not have varnish printed thereon.

Figure 8:
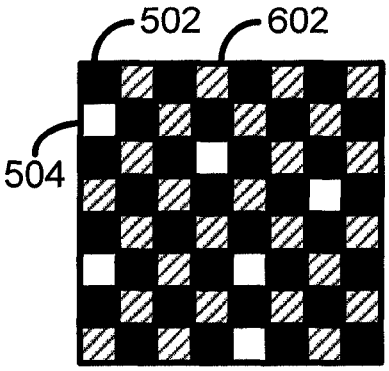
FIG. 8 is a magnified illustration of an array of substrate pixel locations according to one example.

In another example the method modifies the obtained image data to define varnish to be printed on only some of the substrate pixel locations 504 where no ink is defined as to be deposited. The result of this is illustrated in FIG. 8, where it can be seen that some substrate pixel locations are defined to have a drop of ink 502 deposited thereon, some are defined to have a drop of varnish 602 deposited thereon, and some are defined to have no printing fluid 504 deposited thereon. Those substrate pixel locations 602 which are to be defined as to have varnish deposited thereon may be distributed in any suitable manner.

The decision of whether to define varnish drops to be printed on either all of some of the substrate pixel locations where no ink drops are to be deposited will be described further below.

In some circumstances it may be useful to further reduce the amount of varnish printed on a substrate by deciding not to print varnish on all of the substrate pixel locations where no ink drops are to be deposited. For example, printing varnish drops on only 50% of such substrate pixel locations would further reduce the quantity of varnish used, and may still provide a satisfactory level of protection to the substrate. The precise percentage of such substrate pixel locations to have varnish printed on may be determined, for example, based on the type of substrate and the characteristics of the ink or varnish being used. In one example between about 50 and 80% of such substrate pixel locations may have varnish printed thereon. In other examples a higher or lower percentage may be chosen. Testing may be used to determine a satisfactory level of substrate coverage depending on precise requirements.

Once the modified image data has been generated it may be used by a printing system, such as the printing system 100, to print both ink and varnish on a substrate in accordance with the modified image data.

In one example, such a printed substrate has ink printed thereon at some substrate pixel locations, at at least some of pixel locations not having ink printed thereon will have varnish printed thereon.

In one example, where the print engine 102 comprises one or multiple scanning printheads, The controller 110 controls the printing system 100, in accordance with the modified image data, to print and cure a swath of ink. The controller 110 then controls the printing system 100, in accordance with the modified image data, to print a swath of varnish on the swath of printed ink. The controller 110 then can advance the substrate 104 through the print zone 105 to print a subsequent swath.

In one example, the controller 110 controls the printing system 100 to cure ink drops substantially immediately after being printed.

In one example controller 110 controls the printing system 100 to cure varnish drops substantially immediately after being printed.

In another example, however, the controller 110 controls the printing system 100 to cure the varnish drops only after a predetermined delay. Delaying the curing of the varnish drops allows the varnish drops to settle prior to being cured, which can result in a finish that has a higher level of gloss compared to curing the varnish drops without delaying the curing thereof. In one example curing of varnish may be delayed for between about 5 and 60 seconds. In other examples curing of varnish may be delayed for a shorter or longer length of time.

Figure 9:
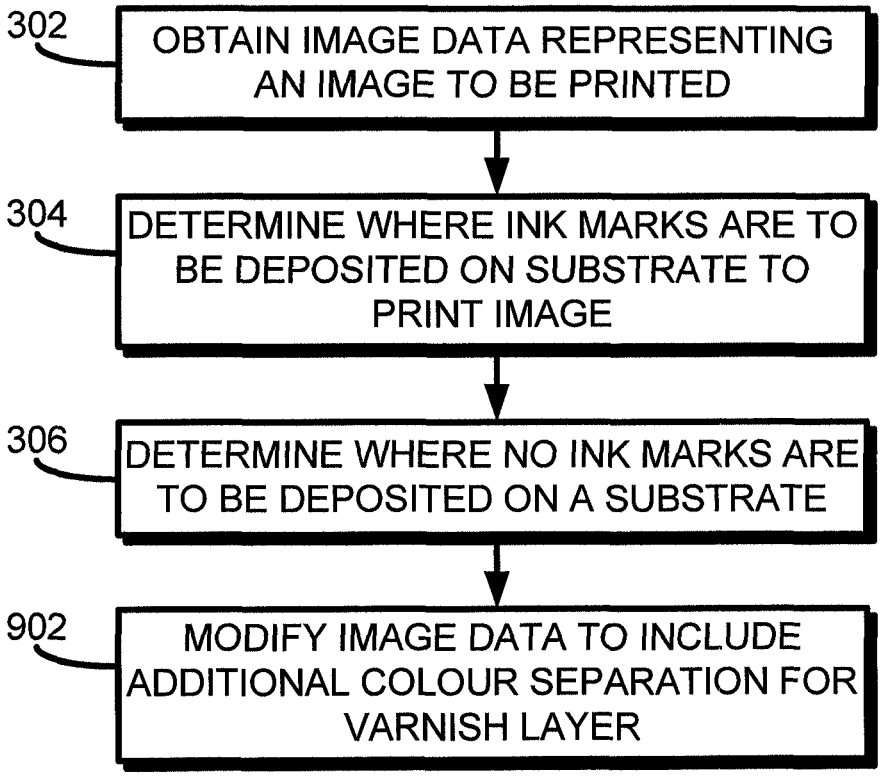
FIG. 9 is a flow diagram outlining a method of processing an image according to one example.

FIG. 9 shows a further example of a method of processing an image according to one example.

At blocks 302 to 306 the method performs processing operations as previously described.

At block 902, the method modifies the image data, based on the determined substrate pixel locations where no ink drops are to be deposited, to include an additional colour separation or additional colour channel data or image layer to control a printhead for printing varnish.

Once the modified image data has been generated it may be used by a printing system, such as printing system 100, to print both ink and varnish on a substrate in accordance with the modified image data.

In one example, such a printed substrate has ink printed thereon at some substrate pixel locations, at at least some of pixel locations not having ink printed thereon will have varnish printed thereon. Additionally, some of the substrate pixel locations that ink is printed thereon may also have varnish printed thereon.

The above examples have been described in a somewhat theoretical manner that assumes that the printing system 100 can address an array of square pixels.

In reality, however, it will be appreciated that printing fluid drops are not square. Furthermore, inherent in accuracies in inkjet printing technologies may result in printing fluid drops being somewhat irregular in nature. For example, in a fixed size drop printing system, the size of printing fluid drops may vary over time for numerous reasons. Some reasons may include, for example, wherein inkjet printheads and printhead nozzles becoming partly or wholly obscured by dried or cured ink. Furthermore, ejected printing fluid drops may experience drop placement error where an ejected printing fluid drop does not land exactly where intended, or ejected drops may spread irregularly on a substrate. Still furthermore, some printing fluid drops may comprise smaller satellite drops that may land in an undeterminable manner around the main printing fluid drop.

To address these issues or potential issues many inkjet printing systems eject a greater quantity of printing fluid than theoretically necessary to ensure adequate ink coverage and accurate colour rendition.

Figure 10:
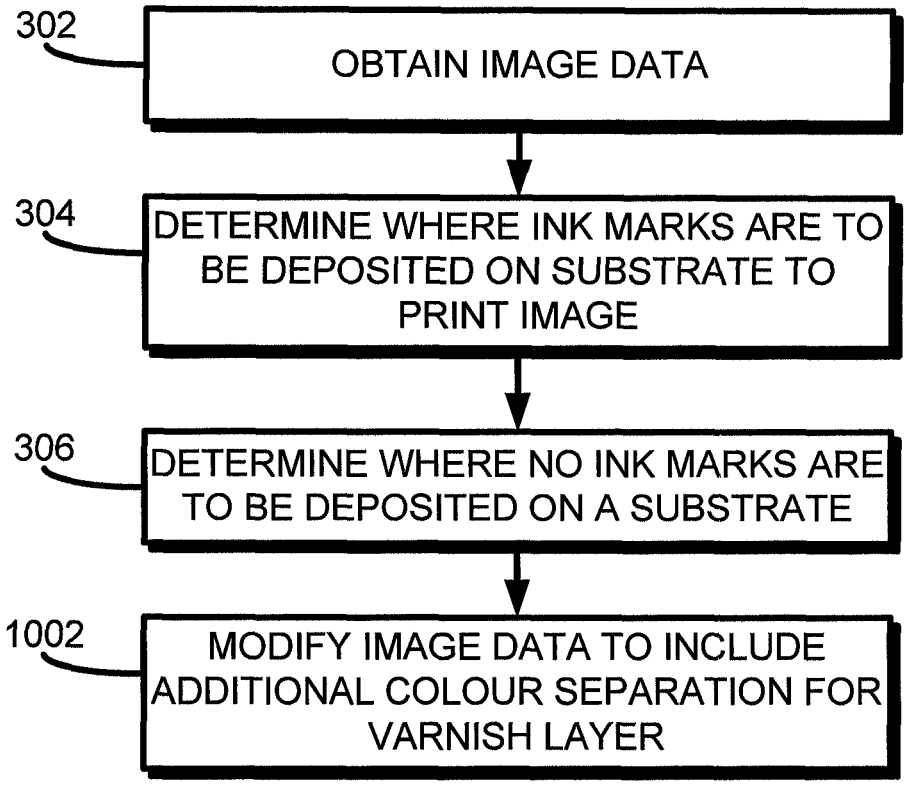
FIG. 10 is a flow diagram outlining a method of processing an image according to one example.

Accordingly, in a further example illustrated with reference to FIG. 10, when the method modifies (block 1002) the image data to generate and include an additional colour separation for the varnish layer based on where it determined no ink drops are to be deposited (block 306), the method also defines additional varnish ink drops in proximity thereto to ensure that adequate varnish coverage is achieved. For example, in one example the method may, for each varnish drop it defines to be printed at a substrate pixel location, define one or multiple additional varnish drop(s) on each substrate pixel location immediately surrounding that substrate pixel location. In other examples, additional varnish drops may be added in different ways.

Once the modified image data has been generated it may be used by a printing system, such as printing system 100, to print both ink and varnish on a substrate in accordance with the modified image data.

The methods and techniques described above are particularly advantageous for use in the production of printed packaging items, such as cardboard boxes. The production of printed packaging items is an important global business with millions of tons being produced each year to protect and display goods.

Printed packaging items destined for retail outlets often comprise elaborate printed content to entice consumers to purchase the packaged goods. Printed packaging items are typically made by printing on flat packaging substrates which are later assembled and glued into completed packaging items.

Figure 11:
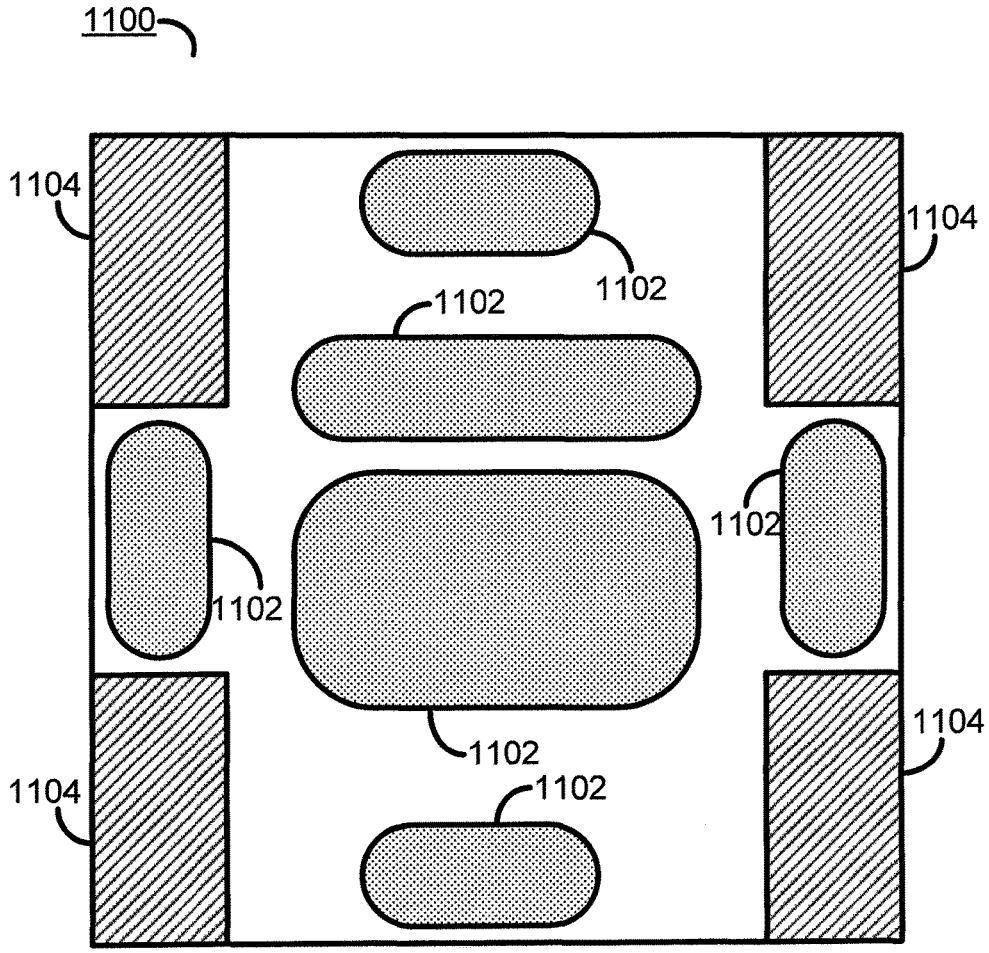
FIG. 11 is an illustration of a printed substrate according to one example.

FIG. 11 illustrates an example printed substrate 1100 suitable for being transformed into a printed packaging item. The substrate 1100 comprises one or multiple printed images 1102. The substrate 1100 also comprises one or multiple areas 1104 that are not to receive any printing fluid. For example, the area or areas 1104 may be areas intended to receive adhesive.

In one example one or multiple printed images may cover the whole of the substrate 1100, excluding the portions 1104.

Figure 12:
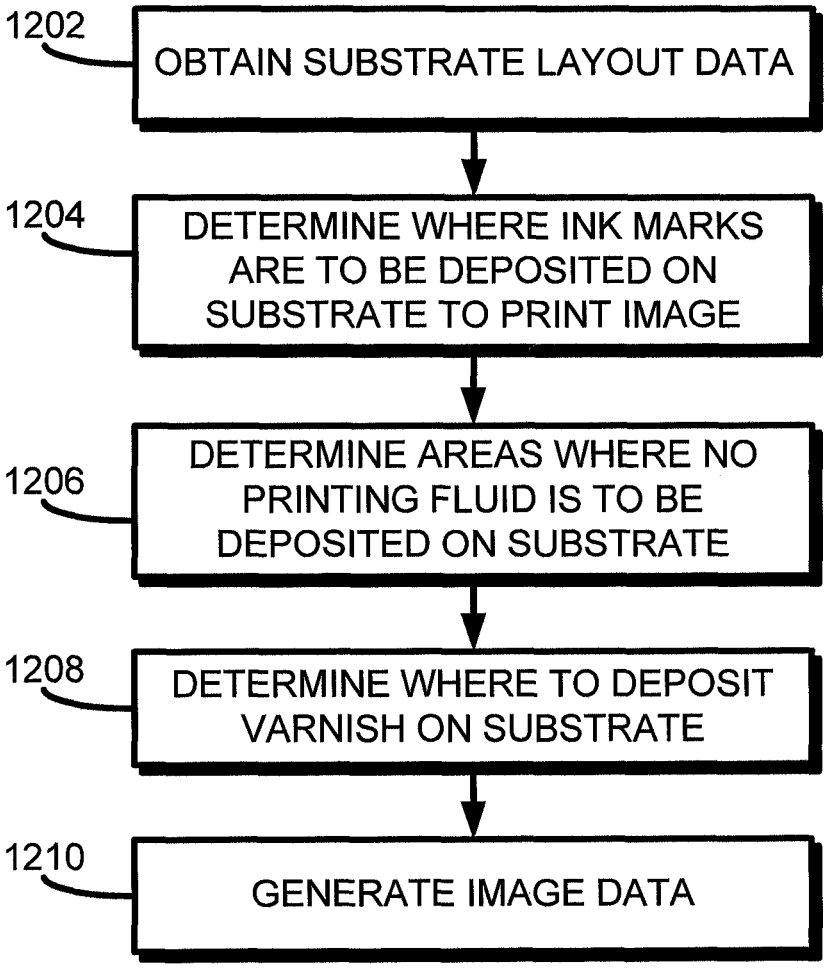
FIG. 12 is a flow diagram outlining a method of processing an image according to one example.

A method of processing an image according to a further example will now be described with additional reference to the flow diagram of FIG. 12.

At block 1202 the method obtains substrate layout data that defines the layout of a substrate to be printed on. The substrate layout data describes one or multiple images 1102 to be printed on the substrate. The images 1102 may include any printable content including graphical and textual content. The substrate layout data additionally describes one or multiple areas 1104 that are not to receive any printing fluid.

The substrate layout data may be described in a suitable image file, such as a portable document format (PDF) format, or any other suitable file format.

At block 1204 the method determines, based on the substrate layout data, at which substrate pixel locations ink drops are to be deposited, as described previously.

At block 1206 the method determines, based on the substrate layout data, which substrate pixel locations are to remain free of printing fluid.

At block 1208 the method determines, based on those substrate pixel locations determined as to receive ink drops and those substrate pixel locations determined to remain free from printing fluid, at which substrate pixel locations varnish drops are to be deposited.

At block 1210 the method generates image data.

Once the image data has been generated it may be used by a printing system, such as printing system 100, to print both ink and varnish on a substrate in accordance with the modified image data.

In this way, the method produces image data that, when printed, will generate a printed substrate that is wholly or substantially covered in either printed ink or printed varnish, except those portions identified as to remain free from printing fluid.

Although the examples described herein have been described in relation to inkjet printing system, in appropriate circumstances other printing techniques may be used in further examples. Accordingly, in other examples the print engine 102 may comprise other printing techniques, such as liquid electro-photographic (LEP) printing techniques, and xerographic printing techniques. Accordingly, the term 'drops' as used herein with reference to inkjet printing techniques should be understood to include, where appropriate, ink 'marks' made by non-inkjet printing techniques.

It will be appreciated that examples and embodiments of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples described herein. Examples described herein may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A method of processing and printing an image, comprising:

obtaining halftone image data representing a halftone image to be printed on a substrate, the image data including substrate pixel locations within the halftone image to remain free from printing fluid;

determining, from the image data, substrate pixel locations within the halftone image where ink is to be deposited and substrate pixel locations within the halftone image where no ink is to be deposited that are surrounded by substrate pixel locations where ink is to be deposited;

modifying the image data to define varnish to be deposited at some or all of those substrate pixel locations within the halftone image where no ink is to be deposited and which are not defined as substrate pixel locations to remain free from printing fluid, to form modified image data; and depositing ink and varnish on the substrate according to the modified image data.

2. The method of claim 1, wherein modifying the image data includes modifying the image data such that no varnish is to be deposited at those substrate pixel locations within the halftone image where ink is to be deposited.

3. A method of processing and printing an image, comprising:

obtaining halftone image data representing a halftone image to be printed on a substrate:

determining, from the image data, substrate pixel locations within the halftone image where ink is to be deposited and substrate pixel locations within the halftone image where no ink is to be deposited that are surrounded by substrate pixel locations where ink is to be deposited;

modifying the image data to define varnish to be deposited at some or all of those substrate pixel locations within the halftone image where no ink is to be deposited and to define, in proximity thereto, additional substrate pixel locations within the halftone image to have varnish deposited thereon, to form modified image data; and depositing ink and varnish on the substrate according to the modified image data.

4. The method of claim 3, wherein modifying the image data includes modifying the image data such that no varnish is to be deposited at those substrate pixel locations within the halftone image where ink is to be deposited.

5. The method of claim 3, wherein the image data defines substrate pixel locations within the halftone image to remain free from printing fluid and modifying the image data includes modifying the image data to define varnish to be deposited at some or all of those substrate pixel locations within the halftone image where no ink is to be deposited and which are not defined as substrate pixel locations to remain free from printing fluid.

6. The method of claim 3, wherein modifying the image data includes modifying the image data to define varnish to be deposited at all of the substrate pixel locations within the halftone image where no ink is to be deposited.

7. A non-transitory memory storing computer understandable instructions that when executed cause a processing system to:

obtain halftone image data representing a halftone image to be printed on a substrate;

determine, from the image data, substrate pixel locations within the halftone image where ink is to be deposited and substrate pixel locations within the halftone image where no ink is to be deposited that are surrounded by substrate pixel locations where ink is to be deposited;

modify the image data to define varnish to be deposited at some or all of those substrate pixel locations where no ink is to be deposited and to define, in proximity thereto, additional substrate pixel locations within the halftone image to have varnish thereon, to form modified image data; and deposit ink and varnish on the substrate according to the modified image data.

8. The memory of claim 7, wherein the instructions to modify the image data include instructions to modify the image data such that no varnish is to be deposited at those substrate pixel locations within the halftone image where ink is to be deposited.

9. The memory of claim 7, wherein the image data defines substrate pixel locations within the halftone image to remain free from printing fluid and the instructions to modify the image data include instructions to modify the image data to define varnish to be deposited at some or all of those substrate pixel locations within the halftone image where no ink is to be deposited and which are not defined as substrate pixel locations to remain free from printing fluid.

10. The memory of claim 7, wherein the instructions to modify the image data include instructions to modify the image data to define varnish to be deposited at all of the substrate pixel locations within the halftone image where no ink is to be deposited.

* * * * *